US005377453A

United States Patent [19]

Perneczky

[11] Patent Number: 5,377,453

[45] Date of Patent: Jan. 3, 1995

[54] AUTOMATED METHOD AND APPARATUS FOR POLISHING HOT STRIP MILL RUN-OUT TABLE ROLLS

[76] Inventor: George C. Perneczky, 8918 Biloba, Orland Park, Ill. 60462

[21] Appl. No.: 16,899

[22] Filed: Feb. 12, 1993

[51] Int. Cl.[6] ..... B24B 49/00

[52] U.S. Cl. ..... 451/1; 451/8; 451/296; 451/313

[58] Field of Search ..... 51/149, 150, 159, 395, 51/396, 397, 211 R, 251, 289 R, 281 R, 326, 165.71, 327, 328, 135 R, 137, 139, 144, 165.74, 165 R, 381

[56] References Cited

U.S. PATENT DOCUMENTS 4,571,893 2/1986 Braasch ..... 51/136

5,193,314 3/1993 Wormley ..... 51/135 R

FOREIGN PATENT DOCUMENTS 51265 2/1989 Japan ..... 51/135 R

*Primary Examiner*—Bruce M. Kisliuk

*Assistant Examiner*—Eileen P. Morgan

*Attorney, Agent, or Firm*—Keck, Mahin & Cate

[57] ABSTRACT

Apparatus for automatically polishing run-out table rolls, comprising: (a) a run-out table polisher take-up reel operatively connected to a carrier belt having abrasive material affixed thereto; and (b) control means for paying out and then retrieving the carrier belt onto the run-out table in response to one or more permissive signals indicative of the operational status of the run-out table. A method of automatically polishing run-out table rolls, comprising: (a) receiving one or more signals indicative of the operational status of a run-out table; (b) processing the signal(s) to determine whether a permissive condition for polishing the run-out table rolls exists; (c) in response to a determined permissive condition, paying out from a take-up reel a carrier belt having abrasive material affixed thereto; and (d) retrieving the carrier belt onto the take-up reel.

16 Claims, 4 Drawing Sheets

AUTOMATED METHOD AND APPARATUS FOR POLISHING HOT STRIP MILL RUN-OUT TABLE ROLLS

BACKGROUND OF THE INVENTION

1. Field of the Invention

The present invention relates to industrial cleaning and polishing technology, and particularly to an apparatus and process for the automatic polishing of hot strip mill run-out table rolls to remove iron deposits from the rolls.

2. Description of the Prior Art

Modern integrated steel mills include a hot strip mill for processing preheated steel slabs into coils. To form steel coils, steel slabs are first introduced into slab preheating furnaces located at one end of the hot strip mill. The resulting preheated slabs then travel over a large number of table rolls in the direction of a scale breaker, after which the slabs travel through either a reversing rougher mill or several continuous roughing mills.

The roughing mills typically reduce the thickness of the slabs from 8" to 10" to ¾" to 1", producing "hot strips" of steel. The hot strips then travel toward a series of finishing stands. A hot strip mill usually includes five to seven finishing stands, each finishing stand consisting of two work rolls and two back-up rolls. The work rolls in a finishing stand must be frequently replaced (two to three times in an eight hour shift), due to the rapid roll surface deterioration which occurs during rolling. The finishing stands further reduce the thickness of the hot strips. The last finishing stand does not significantly reduce the thickness of the hot strips, but establishes the final shape of the surface of the hot strips. At this stage in the processing, the hot strips remain in a plasticized state.

Between the last finishing stand and the down coiler, where the hot strips are formed into coils, there are approximately 300 to 500 run-out table rolls. The hot strips are transported by the run-out table rolls at high speed (40 to 60 miles per hour) in the direction of down coiler pinch rolls. The down coiler pinch rolls grab the hot strips, and direct the leading nose of the hot strips toward a coil-making apparatus. Substantial tension is developed between the down coiler pinch rolls and the coiler to assure the making of tight coils. While the hot strips are traveling over the numerous run-out table rolls, the hot strips are cooled by water sprayed onto the hot strips from above and below.

Since the plasticized hot strips travel over the run-out table rolls at relatively high speeds, iron deposits tend to build up on the surface of the run-out table rolls. The iron deposits often mark up the surface of the hot strips to such an extent that the hot strips cannot be used to manufacture consumer goods.

To remedy this problem, hot strip mills are periodically shut down so that the several hundred run-out table rolls can be hand-ground to clean off the accumulated iron deposits. Hand-grinding poses a significant danger to laborers, however, because the run-out table rolls must be motor-driven while the hand-grinding process is carried out. Moreover, hand-grinding is a time-consuming task which results in an unrecoverable loss of eight to sixteen hours of production every time the mill must be shut-down to clean the run-out table rolls.

Modern hot strip mills are capable of producing three to five million tons of steel coils per annum at a cost of several hundred dollars per ton of steel. However, the poor quality of the manufactured coils resulting from damage caused by iron deposits on the table rolls, and the loss of productivity associated with periodic hand-grinding of the rolls, presently cost hot strip mills tens of millions of dollars per year.

In this regard, a number of hot strip mills have been permanently closed over the past two decades due to lost productivity and the inability of the mills to meet quality demands placed on them by the automobile and other industries. The annual world-wide production of hot-rolled steel coils has in fact been substantially reduced, resulting in a shortage of hot-rolled coils that is projected to continue into the future.

Domestically in the United States, a number of hot strip mills have been modernized at a cost of 200 to 300 million dollars each. The projected cost for a new, state-of-the-art hot strip mill is between 500 million and one billion dollars. It can take five to seven years to complete the construction of a new mill. In view of these costs, there are presently no known plans to build a new hot strip mill anywhere in the world. Accordingly, substantial demands have been placed on existing hot strip mills to reach their maximum production capacities. Increasing mill productivity by just ½%, for example, would result in millions of dollars in savings per annum.

SUMMARY OF THE INVENTION

Applicant has invented an apparatus and method for the automatic polishing of run-out table rolls to remove iron deposits from the same. The invention provides hot-rolled coils of improved quality, while eliminating the conventional practice of hand-grinding as well as the need to shut-down a hot mill in order to clean the run-out table rolls. Use of the present invention will thus permit hot strip mills to increase productivity by reducing significantly the time required to clean the run-out table rolls and will lessen the risks now attendant the polishing of such rolls.

In my copending patent application Ser. No. 08/001,453, filed Jan. 7, 1993, I disclosed a method and apparatus for polishing hot strip mill run-out table rolls that, in part, makes use of equipment existing in the hot strip mill, such as the mill crane, to position the apparatus for the polishing operation.

The present invention improves upon my copending application by providing an apparatus for automatically polishing run-out table rolls which eliminates the need for use of the mill crane during the polishing operation. More particularly, an apparatus is herein disclosed for automatically polishing run-out table rolls, which comprises: (a) a run-out table polisher take-up reel operatively connected to a carrier belt having abrasive material affixed thereto; and (b) control means for paying out and then retrieving the carrier belt onto the run-out table in response to one or more permissive signals indicative of the operational status of the run-out table. The carrier belt is advantageously comprised of a polishing block assembly having a plurality of abrasive blocks attached thereto.

The invention also provides a method for automatically polishing run-out table rolls, the method comprising: (a) receiving one or more signals indicative of the operational status of a run-out table; (b) processing the signal(s) to determine whether a permissive condition for polishing the run-out table rolls exists; (c) in response to a determined permissive condition, paying out from a take-up reel a carrier belt having abrasive material affixed thereto; and (d) retrieving the carrier belt onto the take-up reel.

Preferably, the table roll polishing operation is carried out during the changing of the work rolls in the finishing stands of the hot mill. As noted above, the work rolls in the finishing stands must be frequently replaced (two to three times in an eight hour shift) due to the rapid deterioration of the work roll surfaces which occurs during processing. The majority of modern hot strip mill finishing stands are outfitted with automatic (robotic) roll-changing apparatus. When the work rolls are changed in the finishing stands, the entire mill is shut down for approximately ten to twelve minutes. Applicant has discovered that the run-out table rolls can be automatically polished during the work roll changing operation, using the apparatus and methods provided by the present invention. The invention thereby eliminates the need to shut down an entire hot strip mill for the sole purpose of hand-grinding the run-out table rolls. The polishing block assembly (described in detail below) component of the invention is preferably applied to the run-out table rolls while the rolls are motor-driven at high speed, so as to remove iron deposits which have accumulated on the surface of the run-out table rolls.

Additional benefits from the use of the automated embodiment of the invention will be apparent to those skilled in the art of rolling steel upon a review of this disclosure,. For example, during work roll-changing operations, the mill crane is sometimes unavailable because it is needed for other purposes, such as emergency repairs. The automated embodiment of the invention can nevertheless be used in such circumstances because it does not depend on the use of the mill crane for its operation. The automated embodiment of the invention also readily effects the polishing of all rolls of the run-out table, including the rolls located a distance from and those proximate to the down coiler pinch roll assemblies commonly associated with the run-out table.

Polishing run-out table rolls according to the disclosed invention thus improves productivity, reduces hazardous working conditions, and significantly improves the surface quality of steel coils manufactured in a hot strip mill.

BRIEF DESCRIPTION OF THE DRAWINGS

In the accompanying drawings, wherein like reference numerals refer to like parts.

DESCRIPTION OF THE PREFERRED EMBODIMENT

In order to further define the invention, a description of a nonlimiting preferred embodiment of the invention will be set forth.

Figure 1:
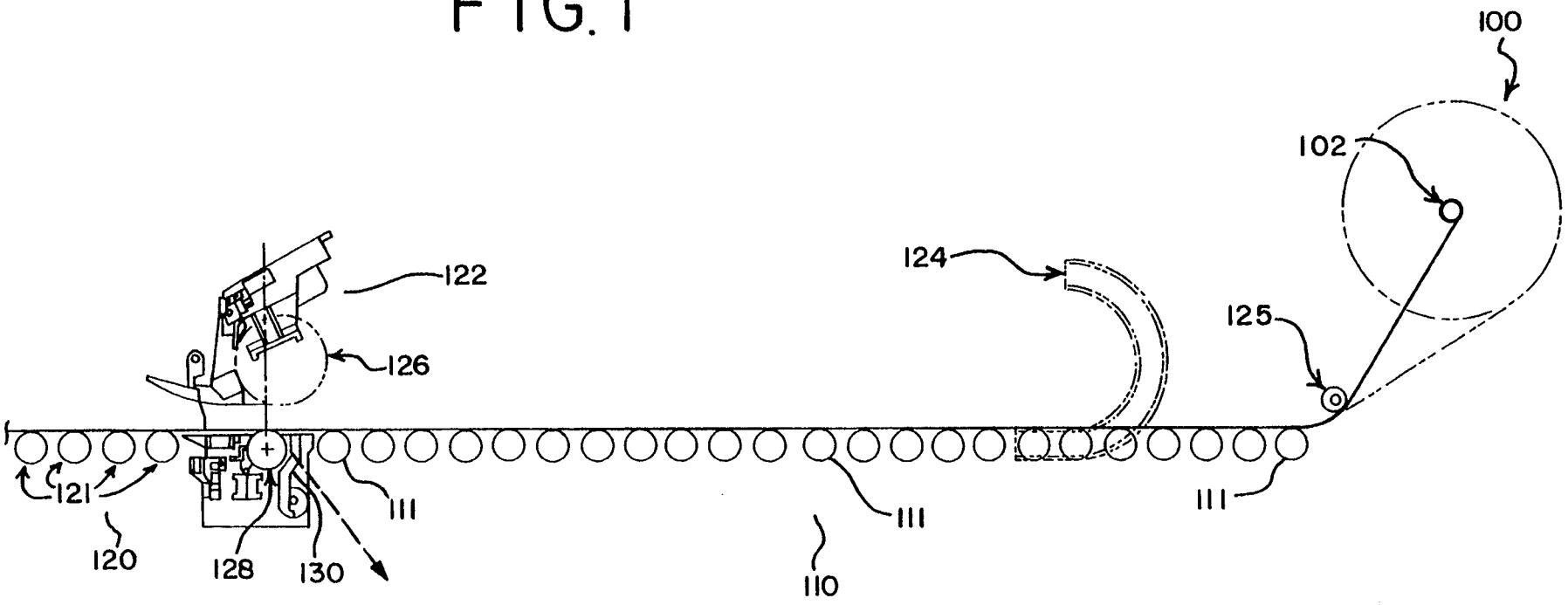
FIG. 1 is a side view of the apparatus of the invention in operation on a series of run-out table rolls.

Referring to FIG. 1, an apparatus for the automatic polishing of run-out table rolls as provided by the invention is depicted. In the typical hot strip mill, the hot strip travels across a run-out table 120, which is comprised of a plurality of spaced-apart run-out rolls 121. Run-out rolls 121 are motor driven and cause the traveling strip to be moved across their surfaces. With reference to FIG. 1, during the operation of the hot strip mill to produce steel, the run-out rolls 121 are turning in the clock-wise direction, with the hot strip thus traveling from left-to-right. In practice, run-out tables, such as table 120, are provided with one or more assemblies such as down coiler assembly 122 or pinch rollers (not shown) located up-stream of the assembly 122. It is also typical that the down coiler assembly 122 is the last assembly along a run-out table 120.

The purpose of the down coiler assembly 122 is to deflect the traveling hot strip in the direction shown by the dashed line and arrow after which the strip is wound into a coil form in coil-forming apparatus (not shown). It should be understood that only a few of the run-out table rolls 121 are shown in FIG. 1. In the typical hot strip mill, there may be as many as 500, or more, of such rolls associated with each run-out table 120. In addition, the run-out table rolls 121 are connected to one or more drive motors (not shown) which rotate the rolls 121 to thereby impart a driving force to the steel strip that is carried on the rolls 121.

In practice, the strip may travel across the run-out table 120 at speeds of 40 to 60 miles per hour. In the event the strip should buckle or otherwise not be deflected by the down coiler assembly 122 to the coil-forming location, it is also typical to provide a deflector, such as cobble deflector 124, at some location downstream of the down coiler assembly 122. The deflector 124 acts to catch a runaway strip and deflect it away from populated areas of the mill. In this regard, it should be appreciated that a runaway strip traveling downstream of the down coiler assembly 122 at a speed approaching 40 to 60 miles per hour may actually be traveling airborne at distances of about 2 to about 4 feet, or more, above the plane of the run-out table 120.

The down coiler assembly 122 comprises, among other things, upper pinch rolls 126, lower pinch rolls 128, strip nose deflector plates 130, and edge guides (not shown). In normal strip mill operation, the pinch rolls 126 and 128 contact the upper and lower surface, respectively, of the traveling strip, and the deflector plates 130 are positioned to guide the strip to the coil-forming apparatus (not shown).

In connection with the present invention, a table 110, which is comprised of a plurality of table rolls 111, is provided downstream of the down coiler assembly 122. The table rolls 111 may conveniently be of the same size and type as the run-out rolls 121; alternatively, the table rolls 111 may be of a less expensive design in that they would not normally be used to transport the strip. The exact number of table rolls 111 will depend on such factors as the space available in the mill for the installation of the present invention, the distance between the assembly 122 and the cobble deflector 124, and other factors. Thus, the number of the rolls 111 shown in FIG. 1 is intended to be descriptive in nature and not limiting the scope of the present invention.

In addition, as shown in FIG. 1, a deflector roll 125 and a take-up reel assembly 100 is also provided, as will be described in detail below. Preferably, the reel assembly 100 is located downstream of the cobble deflector 124 so that the cobble deflector 124 can act as a shield to protect the take-up reel assembly 100 in the event of a runaway strip.

The present invention also includes spaced-apart polishing blocks carried on a belt which can be unwound from and retrieved onto the take-up reel assembly 100 in response to signals indicative of the operating status of the rolls 121 of the run-out table 120, the down coiler assembly 122 and associated upstream pinch rolls (not shown).

Figure 2:
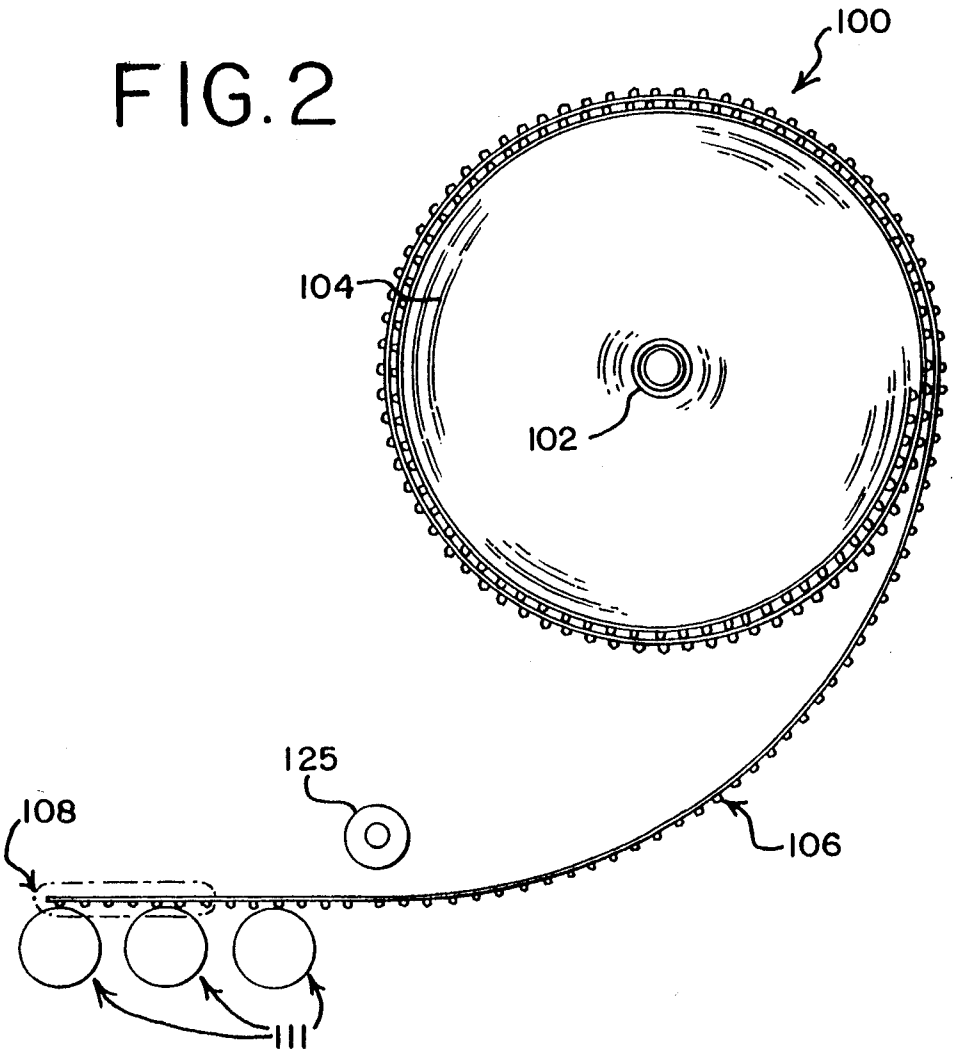
FIG. 2 is a side view of an apparatus of the invention for automatically polishing run-out table rolls.

Referring now to FIG. 2, the take-up reel assembly 100 of the apparatus for automatically polishing run-out table rolls as provided by the invention is depicted. The take-up reel assembly 100 has a cylindrical shaft 102 operatively connected to a controllable electric motor (shown as reference numeral 142 in FIG. 10). Connected to the shaft 102 is carrier belt 104 which may be made of a reinforced synthetic rubber or other suitable material. The carrier belt 104 includes a plurality of spaced-apart polishing blocks 106 securely fastened to the leading end of the carrier belt 104. The carrier belt 104 should be of sufficient length so that when fully extended the polishing blocks 106 at the leading end of the carrier belt 104 will be able to engage and polish the most remote of the run-out table rolls 121. As a consequence, the overall length of the carrier belt 104 may vary from installation to installation.

Preferably, the first 10 to 20 feet of the leading end of the carrier belt 104 are reinforced with a steel backing plate (not shown) or, alternatively, spaced-apart steel channels or flat plate steel slats, to stiffen the nose portion 108 of the carrier belt 104. Stiffening the nose 108 of the carrier belt 104 in this manner helps ensure that the nose 108 does not slip down in between the table rolls 111 and the run-out rolls 121 as the carrier belt 104 is being paid out, yet also ensures that the nose 108 retains a degree of flexibility as it travels across the rolls 111 and 121 in the manner hereinafter described. The weight of the stiffeners provides the additional advantage of allowing the table rolls 111 and the run-out table rolls 121, when running in reverse, to frictionally engage the polishing blocks 106 and thus pay out the carrier belt 104 over the entire length of the run-out table 120.

The deflector roll 125 is associated with the reel assembly 100 and is used to ensure that the belt 104 tracks over the rolls 111. Deflector roll 125 may be motor driven or free-wheeling and may be biased, such as spring biased, to provide tension to the belt 104 as it is unwound from and retrieved onto the take-up reel assembly 100.

Figure 3:
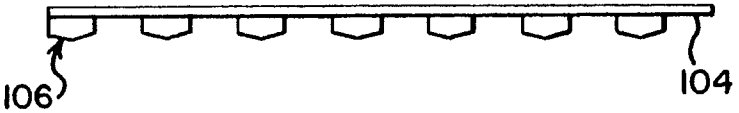
FIG. 3 is an enlarged view of the area circled in FIG. 2 showing the end portion of an embodiment of the invention.
Figure 4:
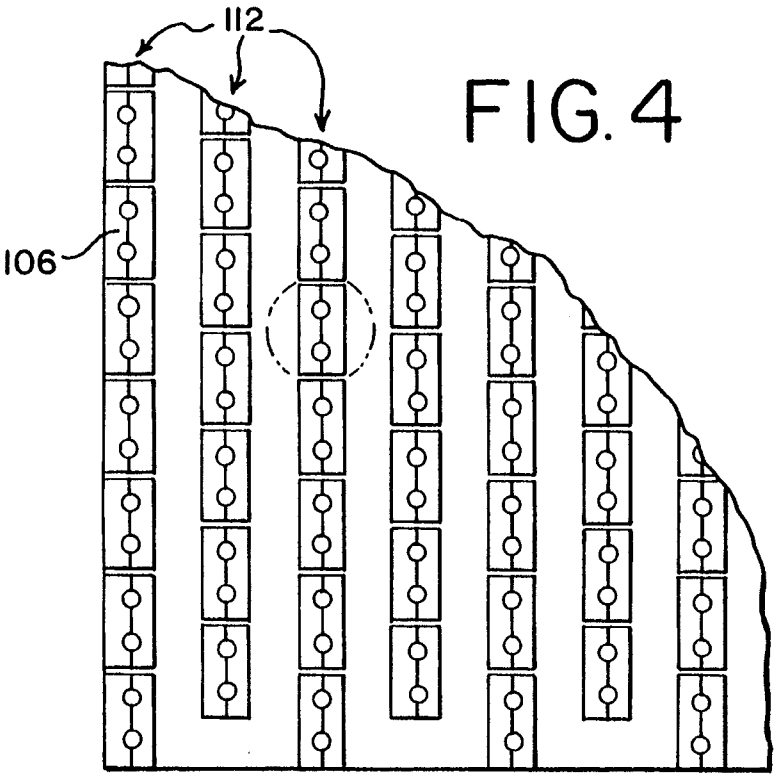
FIG. 4 is a bottom view of a portion of the polishing block assembly of FIG. 3.

An enlarged side view of the leading end of the carrier belt 104 is shown in FIG. 3 and an enlarged bottom view is shown in FIG. 4. It can be seen that the leading end of the belt 104 comprises a plurality of individual polishing blocks 106 identical to one another. The individual polishing blocks 106 are located in a series of rows 112 with the polishing blocks 106 comprising each row positioned in a staggered relationship from row to row. The individual polishing blocks 106 are each removably fastened to the carrier belt 104, as for example by bolts and nuts. In place of polishing blocks 106, however, those skilled in the art upon reading this disclosure will appreciate that an abrasive sheet or pad (not shown) may alternatively be employed in the invention, for example at the stiffened nose 108 of the carrier belt 104.

Figure 5:
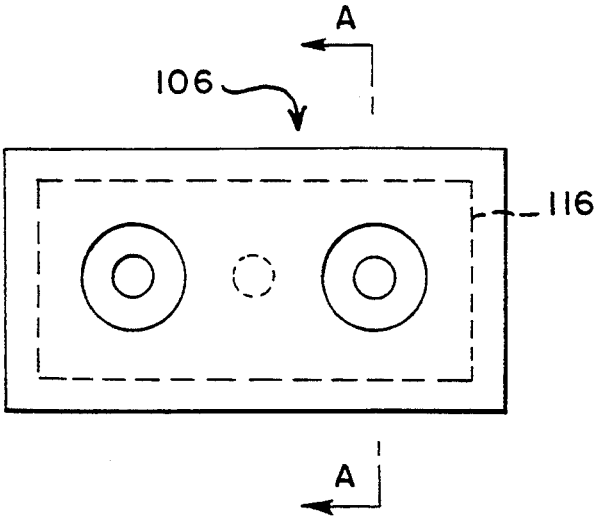
FIG. 5 is an enlarged view of the area circled in FIG. 4 showing a typical individual abrasive block.
Figure 6:
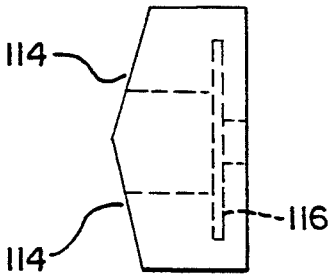
FIG. 6 is a side view of the abrasive block of FIG. 5.
Figure 7:
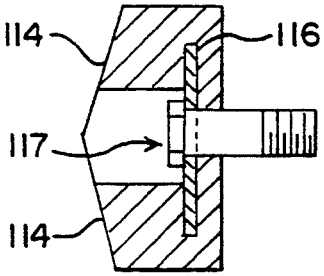
FIG. 7 is a cross-sectional side view taken through section A—A of the abrasive block of FIG. 5.
Figure 8:
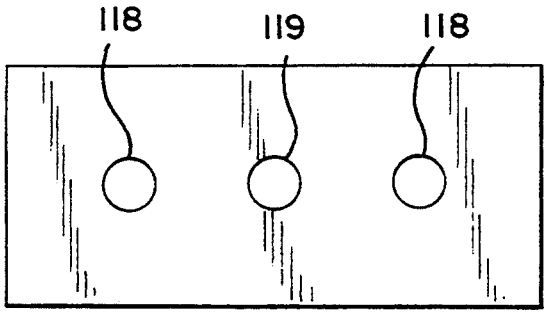
FIG. 8 is a top view of a plate embedded through the abrasive block of FIG. 5.
Figure 9:
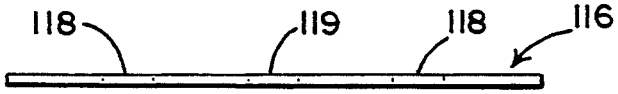
FIG. 9 is a side view of the plate of FIG. 8.

Referring to FIGS. 5–7, the individual abrasive blocks 106 are preferably formed of a dense and hard material, preferably a hard synthetic rubber having abrasive particles homogeneously embedded therein. The blocks 106 include contact surface portions 114. Embedded within each individual polishing block is a steel plate 116 for connecting the polishing block to the carrier belt 104. As shown in FIGS. 8 and 9 the steel plate 116 is provided with an annular opening 119 to enable the material which comprises the blocks 106 to be molded around the plate 116; the opening 119 allows the material to flow therethrough thereby ensuring that the plate 116 can be firmly held within the block 106. In addition, the plate 116 includes openings 118 for receipt of a fastener such as bolts 117 or the like. The blocks 106, which can advantageously be molded around the plate 116, thus can be fastened to the carrier belt 104. While the blocks 106 shown in FIGS. 6 and 7 depict angled contact portions 114, the present invention is not so limited. Rather the contact portions 114 can be formed flat, concave, convex, or in other shapes suitable for contacting and polishing the surface of the run-out table rolls 121.

Figure 11:
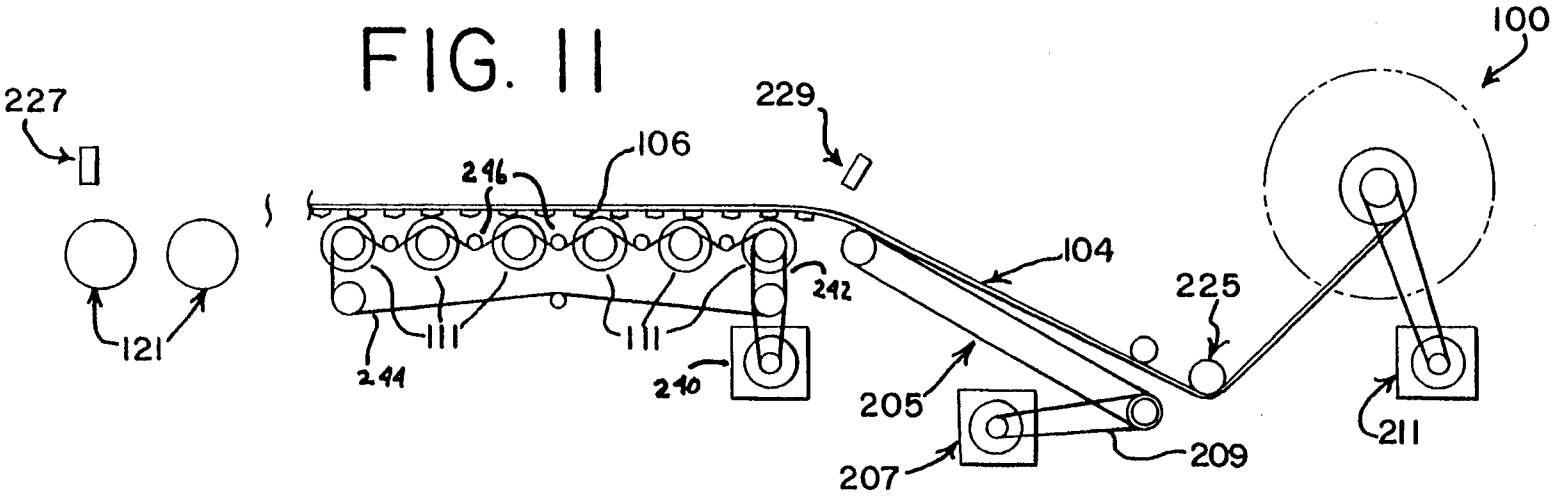
FIG. 11 is a side view of an alternative embodiment of the invention for automatically polishing run-out table rolls.

In operation, the polishing of the run-out table rolls 120 commences with the carrier belt 104 substantially rolled up onto the take-up reel assembly 100 as best shown in FIG. 2. The nose end 108 of the assembly, in the start up position, rests on the first few table rolls 111. When the strip mill is operational, these first few rolls 111 will not be turning. However, during the polishing operation, the table rolls 111 upon which the leading end of the carrier belt 104 is resting (as well as the run-out table rolls 121), will be rotating reversed, i.e., counter clock-wise in reference to FIGS. 1 and 2. It will be appreciated that the rolls 111 are preferably motor driven to assist in the paying out of the belt 104. Although FIGS. 1 and 2 do not depict a drive motor in relation to the rolls 111, one such drive motor arrangement is shown in FIG. 11.

Prior to commencing the polishing operation, the following operations will be performed. All down coiler upper pinch rolls 126, as best illustrated in FIG. 1, must be raised. All down coiler lower pinch rolls 128 must be rotating reversed. The strip nose deflector plates 130 must be in the "down" position, i.e., in a position to allow the leading nose 108 of the carrier belt 104 to travel across and through the down coiler pinch roll assembly 122. All of the edge guides (not shown) of the down coiler assemblies 122 must be in the open position. All pinch rolls (not shown) located upstream of the assembly 122 must be raised; alternatively, if such pinch rolls are not raised, the polishing operation would not be performed upstream of those rolls. Finally, all of the rolls 111 and 121 must be rotating in reverse.

When all these conditions are satisfied, the carrier belt 104 and polishing blocks 106 can begin to be paid out from the take-up reel assembly 100. This is accomplished by the frictional engagement of the nose 108 with the table rolls 111. Because the table rolls 111 are running reversed, i.e., counterclockwise with respect to FIG. 1, they will direct the polishing blocks 106 upstream across the rolls 111, through the down coiler pinch roll assembly 122 associated with the run-out table 120, and across the rolls 121. Once the polishing blocks 106 have has been paid out across the desired length of the run-out table 120, the motor controlling the take-up reel assembly 100 will reverse its direction, i.e., begin rotating counter-clockwise, and thus retrieve the polishing blocks 106 and carrier belt 108, and returning them to the stored position shown in FIG. 2.

Figure 10:
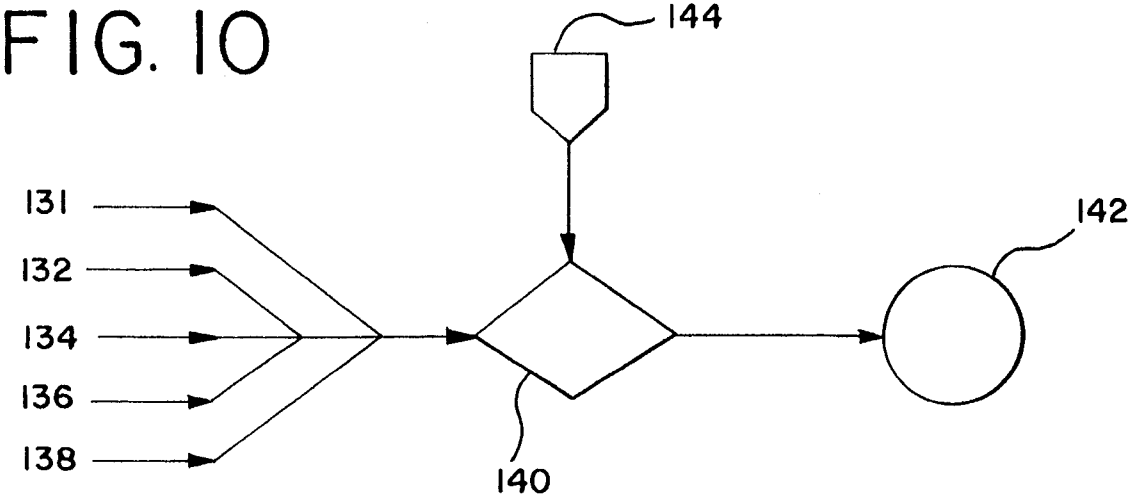
FIG. 10 is a schematic representation of the electronic controls for the automatic operation of one embodiment of the invention.

In actual practice, the entire polishing operation can be performed automatically. FIG. 10 provides a schematic representation of the electronic controls which may be used for the automatic operation of the invention. Signals 131 indicating the position of the down coiler upper pinch rolls 126, signals 132 indicating the position of the down coiler lower pinch rolls 128, signals 134 indicating the position of strip nose guide deflector plates 130, signals 136 indicating the position of the edge guides, and signals 138 indicating the rotational direction of the rolls 111 and 121 are bussed to a programmable logic controller (PLC) 140. When the signals 131, 132, 134, 136, and 138 each indicate a permissive condition for polishing the run-out table rolls 121, the PLC 140 instructs the take-up reel motor 142 to commence paying out the carrier belt 104 and its associated polishing blocks 106.

When the polishing blocks 106 reach the desired end of the polishing operation, such as the end of the run-out table 120, limit switches (not shown) will send a signal to the PLC 140 to stop the unwinding operation. The take up reel motor 142 will then automatically reverse and commence dragging the carrier belt 104 and the polishing blocks 106 back towards the take up reel 100. During this dragging operation, the rolls 121 will continue to run in the reverse, i.e., counter-clockwise, direction to provide fictional engagement with and drag to the blocks 106. Thus, as the belt 104 is retrieved, the blocks 106 will clean and polish the rolls 121. Preferably, the speed at which the polishing blocks 106 and carrier belt 104 are paid out and retrieved may be varied and controlled, for example by a feed rate encoder 144, so that the entire polishing operation may be completed within a predetermined time period set by the mill operator.

Upon completion of the polishing cycle, the nose 108 of carrier belt 104 will not be completely wound up onto the take up reel 100, but rather will be located on several run-out table rolls 111 that are located adjacent, and preferably behind, the cobble deflector 124. In this fashion, the assembly is located in a ready position for the next polishing cycle.

A side view of an alternative embodiment of the invention is shown in FIG. 11. In this embodiment, the take-up reel assembly 100 may conveniently be located at nearly any location downstream of the last down coiler assembly of the run-out table, within the space limitations of the strip mill, while minimizing the number of table rolls 111. As shown in FIG. 11, carrier belt 104 is transported onto the table rolls 111 by conveyor 205. Conveyor 205 is driven by a controllable motor 207, operatively connected, for example, to drive belt 209.

In operation, the polishing cycle will commence with the leading nose portion of carrier belt 104 in a resting position on the conveyor 205. In response to signals indicating a permissive condition for commencing the polishing operation, conveyor 205, driven by motor 207 in synchronization with take-up reel motor 211, will commence paying out the carrier belt 104 and polishing blocks 106 onto the table rolls 111, which are running reversed. The rolls 111 are driven by drive motor 240 which may be connected to one of the rolls 111 via drive belt 242. The remaining rolls 111 may be driven through the action of timing belt 24 which is threadably engaged with the rolls 111 via turning shafts 246. When the leading nose of carrier belt 104 reaches the desired travel distance or the left-most end of the run-out table 120 (not shown in FIG. 11 but shown in FIG. 1), a sensor, such as photoelectric sensor 227, will be tripped, signalling the take-up reel assembly 100 to commence retrieving carrier belt 104. When the nose 108 returns to conveyor 205, a sensor such as a photoelectric sensor 229, is tripped, signalling the motor 211 of the take-up reel assembly 100 that the polishing operation has been completed. At this point in time, the motor 211 ceases and the nose 108 remains at rest on the belt 205 until further polishing operations are to take place.

It will be appreciated by those skilled in the art upon reading this disclosure that the combination of take-up reel assembly 100 with conveyor 205 and deflector roll 225 thus allows the invention to be conveniently positioned. For example, take-up reel assembly 100 may be positioned below the plane of the run-out table 120 thus out of the path of any run-away strip. In this regard, the cobble deflector 124 seen in FIG. 1 is not depicted, for clarity, in FIG. 11.

The roll polishing apparatus and methods provided by the invention therefore eliminate the dangerous practice of hand-grinding run-out table rolls. In addition to this safety improvement, the invention has been found to significantly increase the productivity of hot strip mills by reducing mill shut-down time, yielding substantial cost savings for the steel industry, while also improving the overall quality of the hot-rolled coils produced.

The invention being thus described, it will be obvious that the same may be varied in many ways. Such variations are not to be regarded as a departure from the spirit and scope of the invention, and all such modifications are intended to be included within the scope of the following claims.

What is claimed is:

1. Apparatus for the automatic polishing of run-out table rolls rotating in a first direction, said run-out table rolls associated with a portion of a steel mill, said apparatus comprising:

a reel assembly operably connected to a first drive motor, a carrier belt having one end thereof connected to said reel assembly and at least a portion of the free end thereof having attached thereto in spaced-apart relation a plurality of polishing blocks, said polishing blocks being formed of a moldable, flexible material having an abrasive grit dispersed therein, each of said polishing blocks having a plate associated therewith, said plate being provided with at least one opening for receipt of a fastener to secure each of said polishing blocks to said carrier belt, each of said polishing blocks being further provided with a contact surface, a plurality of rotatable rolls operably connected to a second drive motor adapted to rotate said rotatable rolls, with said plurality of rotatable rolls arranged to transport said free end of said carrier belt and said carrier belt to said run-out table rolls and to direct said contact surface of said polishing blocks and said carrier belt across said run-out table rolls, a signal generator indicating at least the rotation in said first direction and in a second direction of said run-out table rolls with said second drive motor operable in response to a signal from said signal generator whereby said plurality of rotatable rolls are rotated in said first direction when said run-out table rolls are rotating in said first direction, a first sensor associated with said run-out table rolls, said first sensor responsive to the presence of said free end of said carrier belt and providing an operable signal to said first drive motor, a second sensor associated with said rotatable rolls adjacent said reel assembly, said second sensor providing an operable signal to said first drive motor.

2. The apparatus of claim 1, further including a conveyor belt position adjacent said reel assembly to receive the leading end of said free end, said conveyor belt being driven by a third drive motor to feed said free end of said carrier belt to said rotatable rolls.

3. The apparatus of claim 1 or 2 wherein said first sensor and said second sensor each comprise a limit switch electrically connected to said first drive motor.

4. The apparatus of claim 1 or 2 wherein said first sensor and said second sensor each comprise a photoelectric sensor electrically connected to said first drive motor.

5. The apparatus of claim 1, wherein said run-out table rolls and said rotatable rolls are positioned in the same plane and the longitudinal axis of said reel assembly lies above said plane.

6. The apparatus of claim 5, further including a deflector roll positioned between said reel assembly and said rotatable rolls.

7. The apparatus of claim 1, wherein said run-out table rolls and said rotatable rolls are positioned in the same plane and the longitudinal axis of said reel assembly lies below said plane.

8. The apparatus of claim 7, further including a deflector roll positioned between said reel assembly and said rotatable rolls.

9. The apparatus of claim 1, wherein said run-out table rolls and said rotatable rolls are positioned in the same plane and the longitudinal axis of said reel assembly lies in said plane.

10. The apparatus of claim 1, wherein said first drive motor is operable in response to a signal from said signal generator.

11. Apparatus for the automatic polishing of run-out table rolls rotating in a first direction, said run-out table rolls associated with a portion of a steel mill, said apparatus comprising:

a reel assembly operably connected to a first drive motor, a carrier belt having one end thereof connected to said reel assembly and at least a portion of the free end thereof having attached thereto in spaced-apart relation a plurality of polishing blocks, said polishing blocks being formed of a moldable, flexible material having an abrasive grit dispersed therein, each of said polishing blocks being further provided with a contact surface, a plurality of rotatable rolls operably connected to a second drive motor adapted to rotate said rotatable rolls, with said plurality of rotatable rolls arranged to transport said free end of said carrier belt and said carrier belt to said run-out table rolls and to direct said contact surface of said polishing blocks and said carrier belt across said run-out table rolls, a signal generator indicating at least the rotation in said first direction, a controller operably connected to said signal generator, said controller providing a control signal to said first drive motor whereby said reel assembly is rotated to pay out and retrieve said carrier belt.

12. The apparatus of claim 11, wherein said controller further provides a signal to said second drive motor to control the operation of said second drive motor.

13. The apparatus of claims 11 or 12, wherein said controller is a programmable logic controller.

14. A method for the automatic polishing of run-out table rolls rotating in a first direction, said run-out table rolls associated with a portion of a steel mill, said method comprising:

actuating a first drive motor operably connected to a reel assembly in response to a first signal from a signal generator, said first signal indicating at least the rotation of said run-out table rolls in said first direction, paying out from said reel assembly a carrier belt having one end thereof connected to said reel assembly and at least a portion of the free end of said carrier belt having attached thereto in spaced-apart relation a plurality of polishing blocks, said polishing blocks being formed of a moldable, flexible material having an abrasive grit dispersed therein, each of said polishing blocks being further provided with a contact surface, actuating a second drive motor operably connected to a plurality of rotatable rolls to rotate said rotatable rolls, transporting said free end of said carrier belt and said carrier belt across said plurality of rotatable rolls and said run-out table rolls, retrieving said carrier belt onto said reel assembly in a manner such that said contact surface of said polishing blocks contacts the surface of and polishes said run-out table rolls.

15. The method of claim 14, wherein said retrieving step further includes providing a control signal to said first drive motor, whereby the direction of rotation of said reel assembly is reversed to retrieve said carrier belt onto said reel assembly.

16. The method of claim 14, wherein said steps of paying out and retrieving said carrier belt further include the steps of generating a second signal indicative of the location of the free end of said carrier belt along at least a portion of said run-out table rolls and said rotatable rolls and controlling said first drive motor in response to said second signal.

* * * * *